US005722987A

United States Patent [19]

Witbeck

[11] Patent Number: 5,722,987

[45] Date of Patent: Mar. 3, 1998

[54] RESUSCITATOR

[75] Inventor: Wayne O. Witbeck, Ontario, Canada

[73] Assignee: Precious Life Saving Products Inc., Mississauga, Canada

[21] Appl. No.: 363,118

[22] Filed: Dec. 23, 1994

[51] Int. Cl.[6] ..... A61B 17/00

[52] U.S. Cl. ..... 606/201; 601/107; 601/108; 601/41; 128/100.1; 128/101.1; 128/96.1

[58] Field of Search ..... 601/107, 41, 108; 606/201; 602/19; 128/100.1, 101.1, 96.1

[56] References Cited

U.S. PATENT DOCUMENTS

| | | | |
|---|---|---|---|
| D. 338,533 | 8/1993 | Burget et al. | D24/206 |
| 517,481 | 4/1894 | Pressey . | |
| 1,175,671 | 3/1916 | Acklen . | |
| 2,036,248 | 4/1936 | Acklen . | |
| 2,067,268 | 7/1937 | Hans . | |
| 2,204,738 | 6/1940 | Swan . | |
| 2,223,570 | 12/1940 | McMillin . | |
| 2,670,734 | 3/1954 | Wittenberg | 128/101.1 |
| 3,078,842 | 2/1963 | Gray . | |
| 4,059,099 | 11/1977 | Davis . | |
| 4,664,098 | 5/1987 | Woudenberg et al. . | |
| 4,726,357 | 2/1988 | DeStefano . | |

FOREIGN PATENT DOCUMENTS

| | | |
|---|---|---|
| 2025234 | 3/1992 | Canada . |

*Primary Examiner*—Michael Powell Buiz
*Assistant Examiner*—Kevin Truong
*Attorney, Agent, or Firm*—Barrigar & Mos

[57] ABSTRACT

A resuscitator is disclosed for rendering assistance to a choking victim in a manner similar to the abdominal thrust method or Heimlich manoeuvre. The resuscitator has a planar handle member with opposed end portions having finger openings to form hand grips. A raised, rounded pad is located between the end portions and extends perpendicular to the handle member. The pad has a rectangular or diamond shaped base in plan view orientated so that V-shaped side walls fit the shape of the pit of the stomach.

20 Claims, 3 Drawing Sheets

RESUSCITATOR

BACKGROUND OF THE INVENTION

1. Field of the Invention

This invention relates to resuscitators or medical devices for applying compressive forces to a person's abdomen, such as in the performance of the abdominal thrust method, sometimes referred to as the Heimlich manoeuvre.

2. Description of the Prior Art

The abdominal thrust method or manoeuvre is a highly recommended procedure for the relief of a person who is choking. In the abdominal thrust manoeuvre, a person giving assistance to a choking victim stands behind the victim and places his or her arms around the torso of the victim, clasping the hands together and thrusting upwardly and inwardly to apply pressure to the abdomen below the sternum and the xiphoid process or the tip of the breastbone. This causes air to be expelled from the lungs to expel the foreign matter on which the victim is choking. A difficulty with the abdominal thrust method or manoeuvre, however, is that if the victim is a large person or the person giving assistance is small or has small hands, or is weak, such as an old person, it is often not possible to apply the necessary force to the victim's abdomen. Another problem is that if the person giving assistance is too large or too strong, serious damage can be done to the victim's internal organs through the application of excessive force.

A device intended to overcome some of the limitations of the abdominal thrust method or manoeuvre is shown in U.S. Pat. No. 4,059,099 issued to Bedford L. Davis. This patent shows a cylindrical pressure pad having tubular handles extending outwardly therefrom. While this Davis device would be of benefit to a smaller person trying to apply pressure to the abdomen of a larger person, the shape of the cylindrical pressure pad and the tubular handles makes it difficult to properly apply the force required without causing injury to the victim.

Another example of this type of device is shown in Canadian Patent No. 2,025,234 issued to Albert Marcucci. While this Marcucci device is an improvement over the Davis device in respect of effectiveness and lessening the likelihood of injury, the resuscitator of the present invention is a further improvement over the Marcucci device.

SUMMARY OF THE INVENTION

In the present invention, a raised, rounded pad is mounted on a handle member in such a manner that the maximum kinetic energy or thrusting force can be administered to the victim, or self-administered, but with appropriate safeguards to reduce the likelihood of injury to the victim.

According to one aspect of the invention, there is provided a resuscitator comprising an elongate handle member having opposed end portions and a central axis extending therebetween. A raised, rounded pad is located between the end portions and extends along an axis perpendicular to the handle member axis. Also, the pad has a V-shaped base extending in a direction perpendicular to both the handle member axis and the pad axis.

According to another aspect of the invention, there is provided a resuscitator comprising an elongate, planar handle member having a longitudinal axis and opposed end portions. Each end portion defines a finger opening therein to form a hand grip in the end portion. The handle member is between 28 and 30 centimetres in length. Also, a raised, rounded pad is located between the end portions and extends transversely of the handle member in a direction generally normal to the plane of the handle member.

BRIEF DESCRIPTION OF THE DRAWINGS

Preferred embodiments of the invention will now be described, by way of example, with reference to the accompanying drawings, in which.

DESCRIPTION OF THE PREFERRED EMBODIMENTS

Figure 1:
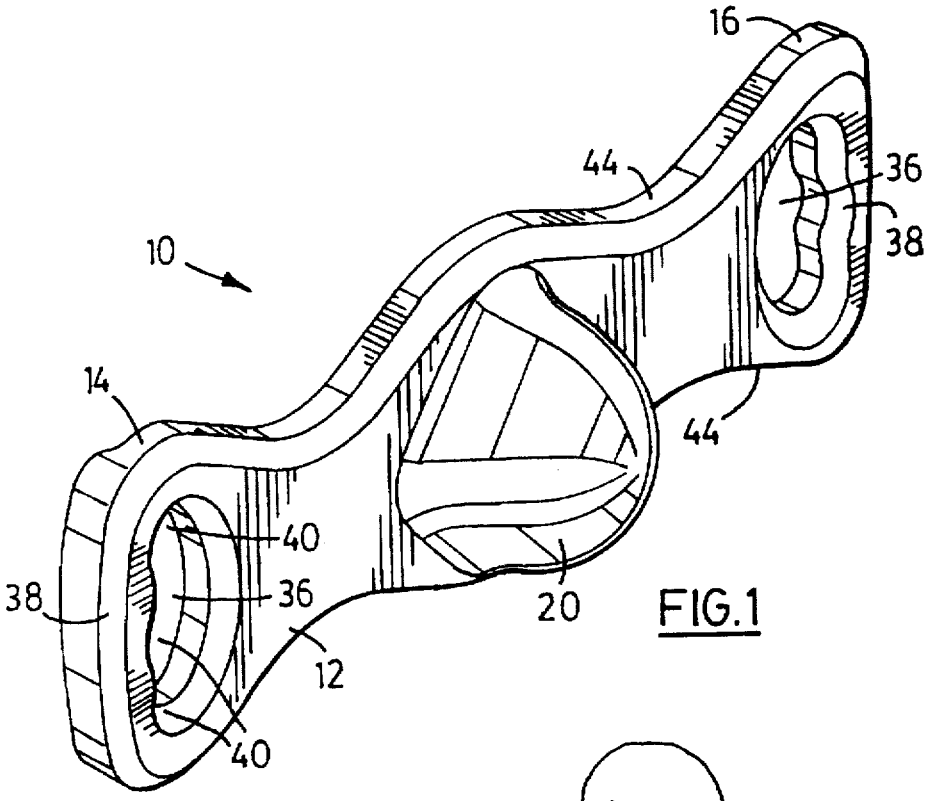
FIG. 1 is a perspective view of a preferred embodiment of a resuscitator according to the present invention.

Referring to the drawings, a preferred embodiment of a resuscitator according to the present invention is generally indicated in the drawings by reference numeral 10. Resuscitator 10 includes an elongate handle member 12 having opposed end portions 14, 16, and a longitudinal, central axis 18 extending between end portions 14, 16. A raised, rounded pad 20 is located between end portions 14, 16 and extends along an axis 22 perpendicular to the handle member axis 18.

Figure 3:
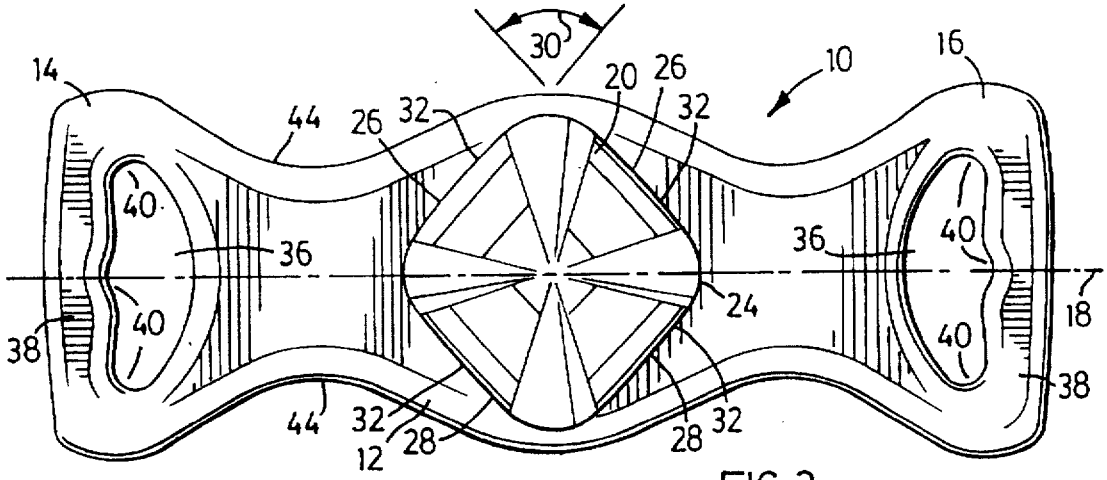
FIG. 3 is a top or plan view of the resuscitator of FIG. 1.

Pad 20 has a peripheral base 24 formed of back-to-back V-shaped base portions 26, 28 making the base 24 generally rectangular or diamond shaped in plan view as seen best in FIG. 3. The V-shaped base portions 26, 28 extend in a direction perpendicular to both the handle member axis 18 and the pad axis 22. The V-shaped base portions have a base angle 30 at the apex of the V of between 75 and 105 degrees. Pad 20 is thus of oblate hemispheroidal shape having somewhat flattened sides 32 which blend smoothly from base 24 to a slightly flattened, rounded top surface 34 of pad 20. Handle member 12 is a planar member and base 24 is disposed in a plane parallel to the planar handle member 12.

Figure 4:
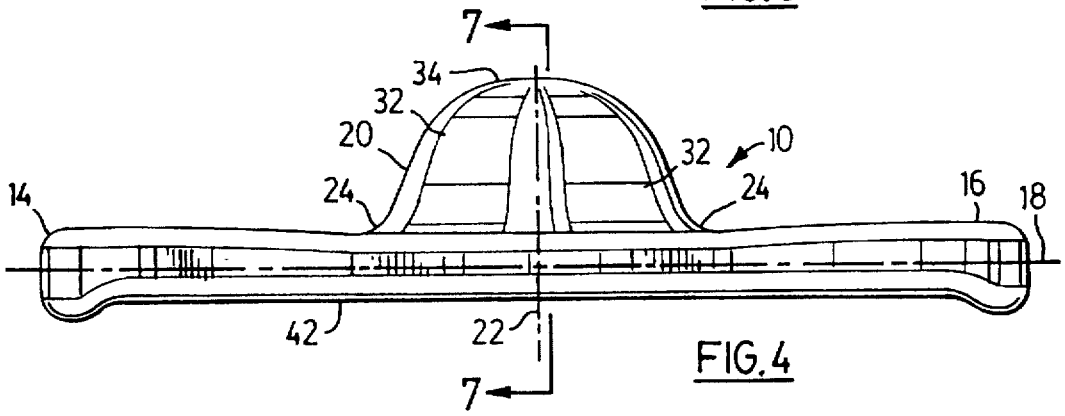
FIG. 4 is a side or elevational view of the resuscitator.
Figure 5:
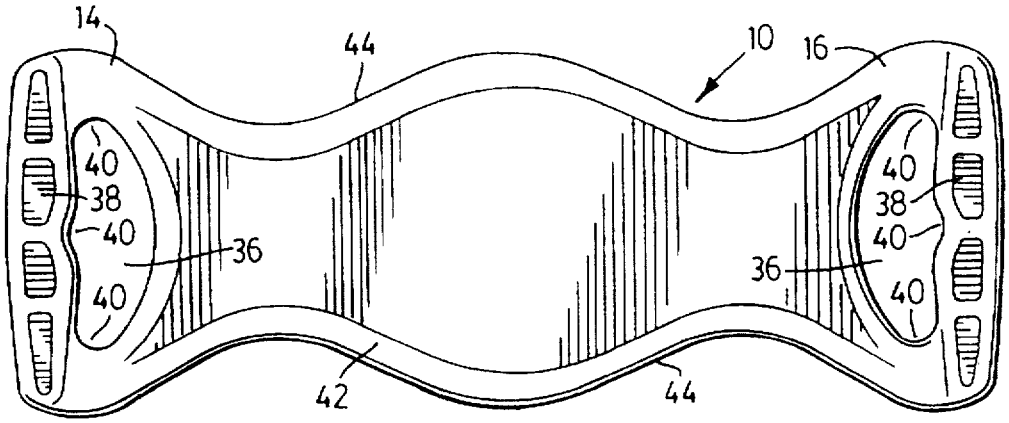
FIG. 5 is a bottom view of the resuscitator.
Figure 6:
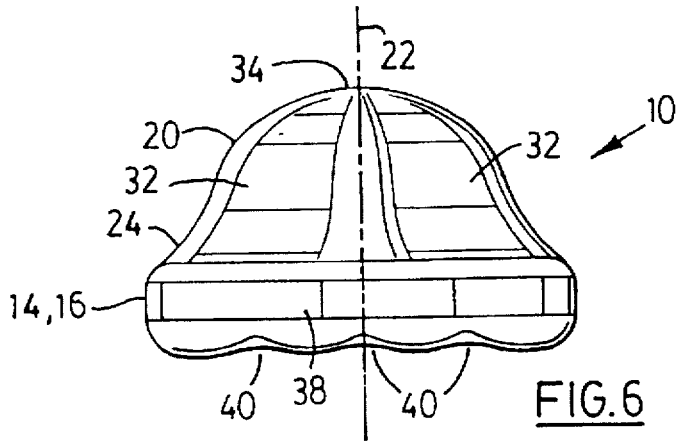
FIG. 6 is an end view of the resuscitator.

Handle member end portions 14, 16 define finger openings 36 thereby forming distal hand grips 38 in end portions 14, 16. Finger openings 36 are D-shaped and hand grips 38 are formed with indentations 40 to accommodate a user's fingers. As seen best in FIGS. 4 and 5, handle member 12 has a flat bottom surface 42. Handle member 12 also has sinusoidal side walls 44 to clear a victim's ribs when resuscitator 10 is used, as will be described further below.

Figure 7:
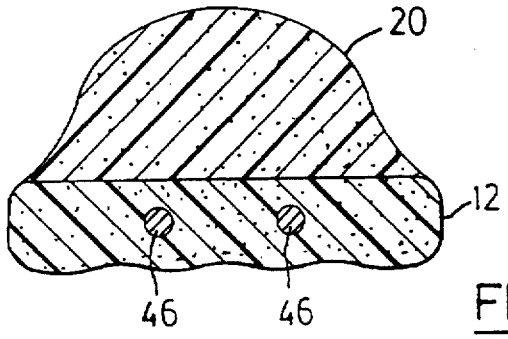
FIG. 7 is a vertical sectional view taken along lines 7—7 of FIG. 4.
Figure 8:
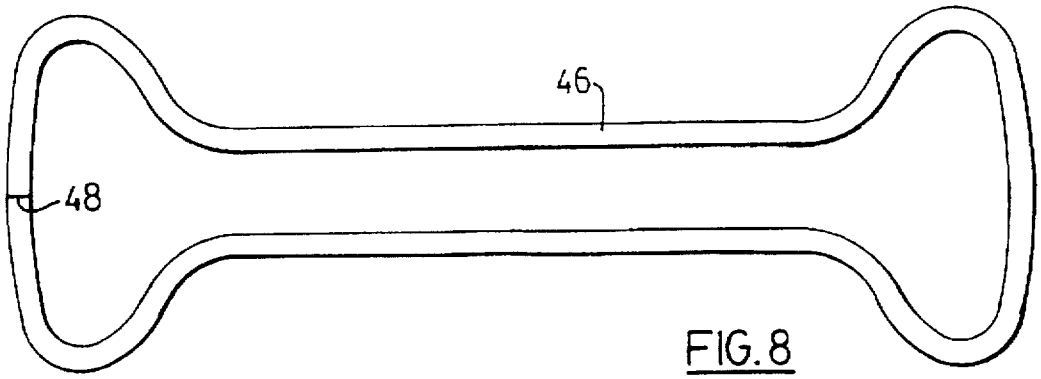
FIG. 8 is a plan view of the spring steel insert used in the resuscitator.

As seen best in FIG. 7, resuscitator 10 is formed of moulded, integral-skin or self-skinning polyurethane foam in two densities. The density of the foam in pad 20 is between 128 and 290 kilograms per cubic metre and the density of the foam in handle 12 is between 190 and 350 kilograms per cubic metre. The two densities of foam are moulded together by pouring, injecting or reaction injection moulding (RIM) processes. The indentation load deflection (ILD) of pad 20 is between 13.6 and 18 kilograms. Preferably, pad 20 has an orange peel or mottled or pebbled surface texture to make it non-slipping. Handle 12 also includes a spring steel stiffening insert 46 located therein. As seen best in FIG. 8, stiffening insert 46 is in the form of a wire loop formed to correspond with the peripheral shape of resuscitator 10 and encircle finger openings 36. Insert 46 is formed of spring steel rod having a diameter between 3 and 8 mm and a tensile strength between 900 and 1250 MPa. Insert 46 can be welded prior to heat treatment to form a continuous loop, or it can have a joint 48. If it has a joint, the joint should be located in the centre of one of the ends that will be in a hand grip 38 as indicated in FIG. 8.

The length of handle member 12 is between 28 and 38 centimetres and the height of pad 20 from handle member 12 is between 3.8 and 6.4 centimetres. The width of resuscitator 10 typically is between 9 and 15 centimetres. The dimensions of the diamond shaped base 24 are such that the lengths of the diagonals are of between 9 and 13 centimetres.

Preferably, resuscitator 10 is colored a fluorescent color to make it easily visible when needed in an emergency.

Figure 2:
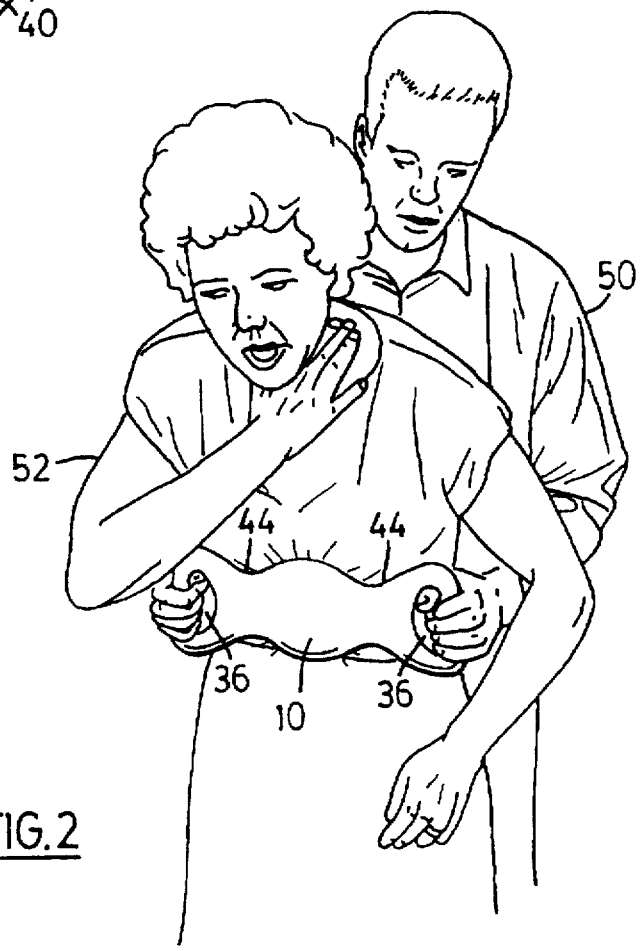
FIG. 2 is an illustration of the use of the resuscitator of FIG. 1.

In use, referring to FIG. 2, a person 50 rendering assistance to a choking victim 52 grasps resuscitator 10 placing his fingers in finger openings 36 while placing his or her arms around the torso of the victim from behind. Pad 20 faces the victim and is located just below the sternum or breast bone and the xiphoid process or tip of the breastbone. Because the rectangular or diamond shaped base 24 of pad 20 is orientated such that a diagonal thereof is disposed perpendicular to the longitudinal axis of handle 12, the V-shaped sides 32 of pad 20 match the diverging angle of the victim's ribs, so that pad 20 nicely fills the area referred to as the pit of the stomach or the solar plexus. Sinusoidal side walls 44 also provide recesses to clear the victim's ribs. In this way, the maximum kinetic energy is transferred to the victim as resuscitator 10 is pulled sharply inwardly and upwardly by the person rendering assistance. However, because of the resiliency and dimensions of resuscitator 10, the chance of injuring the internal organs of the victim is greatly reduced using resuscitator 10. It will be appreciated that resuscitator 10 is symmetrical about axis 18, so it does not matter which hand is inserted into which finger opening 36.

Having described preferred embodiments of resuscitator 10, it will be appreciated that various modifications can be made to the structure described. For example, pad 20 is described as being rectangular or diamond shaped in plan view. However, pad 20 could be triangular in plan view. While this may even transfer more kinetic energy to a victim than a diamond shape, it is desirable that the V-shaped base align with the rib cage and with a triangularly shaped pad, a person rendering assistance could get confused as to the proper orientation of resuscitator 10 in an emergency situation, so the rectangular or diamond-shaped pad 20, since it is symmetrical, is preferred. Resuscitator 10 could be made of other materials then self-skinning foam and it could also be made of material of a single density. Other types of stiffening inserts could be used or the stiffening insert could be eliminated depending upon the material chosen for handle member 12.

It will be apparent to those skilled in the art that in light of the foregoing disclosure, many alterations and modifications are possible in the practise of this invention without departing from the spirit or scope thereof. Accordingly, the scope of the invention is to be construed in accordance with the substance defined in the following claims.

What is claimed is:

1. A resuscitator comprising:

an elongate stiffened, resilient handle member having opposed end portions and a central axis extending therebetween;

a raised, rounded pad located between said end portions and extending along an axis perpendicular to the handle member axis; and said pad having a base portion extending in a direction perpendicular to both the handle member axis and the pad axis, said base portion being V-shaped in plan view.

2. A resuscitator as claimed in claim 1 wherein the pad has a base including back-to-back V-shaped base portions making the base generally diamond-shaped in plan view.

3. A resuscitator as claimed in claim 2 wherein the pad is of oblate hemispheroidal shape.

4. A resuscitator as claimed in claim 2 wherein the diamond-shaped base has diagonal lengths between 9 and 13 centimetres.

5. A resuscitator as claimed in claim 1 wherein the handle member is planar and the V-shaped base is disposed in a plane parallel to said planar member.

6. A resuscitator as claimed in claim 5 wherein the handle member end portions each define a finger opening thereby forming a distal hand grip in each end portion.

7. A resuscitator as claimed in claim 5 wherein the handle member and pad are formed of moulded integral-skin polyurethane foam.

8. A resuscitator as claimed in claim 7 wherein density of the foam in the handle is between 190 and 350 kilograms per cubic metre.

9. A resuscitator as claimed in claim 7 wherein the density of the foam in the pad is between 128 and 290 kilograms per cubic metre.

10. A resuscitator as claimed in claim 7 wherein the handle member further comprises a spring steel stiffening insert located therein.

11. A resuscitator as claimed in claim 10 wherein said insert is a wire loop formed of spring steel rod having a diameter between 3 and 8 mm and a tensile strength between 900 and 1250 MPa.

12. A resuscitator as claimed in claim 1 wherein the length of the handle member is between 28 and 38 centimetres and the height of the pad from the handle member is between 3.8 and 6.4 centimetres.

13. A resuscitator as claimed in claim 1 wherein the V-shaped base has a base angle at the apex of the V of between 75 and 105 degrees.

14. A resuscitator comprising:

an elongate, stiffened, resilient, planar handle member having a longitudinal axis and opposed end portions, each end portion defining a finger opening therein to form a hand grip in the end portion, the handle member being between 28 and 38 centimetres in length; and a raised, rounded pad located between said end portions and extending transversely along an axis perpendicular to the handle member in a direction generally normal to the plane of the handle member, said pad having a base portion extending in a direction perpendicular to both the longitudinal axis and the pad axis, said base portion being V-shaped in plan view.

15. A resuscitator as claimed in claim 14 wherein the pad has a generally rectangular base located in a plane parallel to the handle member, the rectangular base being orientated such that a diagonal thereof is disposed perpendicular to the longitudinal axis of the handle member.

16. A resuscitator as claimed in claim 15 wherein the handle member and pad are formed of moulded integral-skin polyurethane foam.

17. A resuscitator as claimed in claim 16 wherein the handle member further comprises a spring steel stiffening insert located therein.

18. A resuscitator as claimed in claim 17 wherein said insert is a wire loop disposed around the periphery of the handle member formed of spring steel rod having a diameter between 3 and 8 mm and a tensile strength between 900 and 1250 MPa.

19. A resuscitator as claimed in claim 10 wherein the density of the foam in the handle is between 190 and 350 $Kg/m^3$ and the density of the foam the pad is between 128 and 290 $Kg/m^3$.

20. A resuscitator as claimed in claim 15 wherein the pad is of oblate hemispheroidal shape.

* * * * *

UNITED STATES PATENT AND TRADEMARK OFFICE

CERTIFICATE OF CORRECTION

PATENT NO. : 5,722,987

DATED : March 3, 1998

INVENTOR(S) : Wayne O. Witbeck

It is certified that error appears in the above-identified patent and that said Letters Patent is hereby corrected as shown below:

On the title page item [73], the name "Precious Lite Saving Products Inc." should read -- Precious Life Saving Products Inc. --

Signed and Sealed this

Fifth Day of January, 1999

*Attest:*

*Attesting Officer*

*Acting Commissioner of Patents and Trademarks*